US008341899B2

(12) United States Patent
Solomon et al.

(10) Patent No.: US 8,341,899 B2
(45) Date of Patent: Jan. 1, 2013

(54) CAFE

(76) Inventors: Lisa B. Solomon, Dallas, TX (US); Gary B. Solomon, Dallas, TX (US)

( * ) Notice: Subject to any disclaimer, the term of this patent is extended or adjusted under 35 U.S.C. 154(b) by 0 days.

(21) Appl. No.: 12/860,630

(22) Filed: Aug. 20, 2010

(65) Prior Publication Data

US 2011/0041434 A1 Feb. 24, 2011

Related U.S. Application Data

(60) Provisional application No. 61/274,814, filed on Aug. 21, 2009.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl. ..... 52/234; 52/745.05

(58) Field of Classification Search ..... 52/234, 52/745.05, 33, 34, 36.1, 36.2; 186/35, 36, 186/38–51, 53

See application file for complete search history.

(56) References Cited

U.S. PATENT DOCUMENTS

| | | | | |
|---|---|---|---|---|
| 3,091,815 | A * | 6/1963 | Krawiec | 52/31 |
| 3,778,911 | A * | 12/1973 | Woolman | 434/432 |
| 4,074,793 | A * | 2/1978 | Yuter | 186/38 |
| 4,245,720 | A * | 1/1981 | Neill, Jr. | 186/38 |
| 4,274,233 | A * | 6/1981 | Currier | 52/33 |
| 5,193,648 | A * | 3/1993 | Yuter | 186/38 |
| 5,775,033 | A * | 7/1998 | Meehan | 52/33 |
| 6,290,025 | B1 * | 9/2001 | Lynn et al. | 186/46 |
| 6,832,453 | B2 * | 12/2004 | Petroski et al. | 52/174 |
| 7,019,644 | B2 * | 3/2006 | Barrie | 340/539.13 |
| 2004/0077423 | A1 * | 4/2004 | Weston et al. | 472/137 |
| 2004/0150520 | A1 * | 8/2004 | Barrie | 340/539.13 |
| 2005/0125299 | A1 * | 6/2005 | McCole | 705/21 |
| 2007/0000185 | A1 * | 1/2007 | DeLine | 52/33 |
| 2009/0101445 | A1 * | 4/2009 | Mack | 186/38 |
| 2009/0107063 | A1 * | 4/2009 | Pierson et al. | 52/236.1 |
| 2010/0056285 | A1 * | 3/2010 | Weston et al. | 472/136 |

* cited by examiner

*Primary Examiner* — Mark Wendell

(74) *Attorney, Agent, or Firm* — Fish & Richardson P.C.

(57) ABSTRACT

A cafe may include a food purchasing area, a primary dining area, and a primary child play area. The primary child play area may be defined by at least one wall and be surrounded by the primary dining area. The wall(s) may be substantially transparent. Seats may be positioned around the primary child play area to enable parents to view children within the primary child play area. In one embodiment, the wall(s) extend from floor to ceiling. The café may include a classroom in which classes for the children are conducted. Sound absorbent material may be positioned above the primary play area to reduce sound from the primary play area entering the primary dining area.

36 Claims, 2 Drawing Sheets

CAFE

CROSS-REFERENCES TO RELATED APPLICATIONS

This application claims priority to U.S. Provisional Application Ser. No. 61/274,814, filed on Aug. 21, 2009, the entire disclosure of which are incorporated herein by reference.

BACKGROUND

Parents are always looking for child-friendly places to bring their infants, toddlers, and young children ("children") that allow for the parents to socialize, have something to eat, and feel comfortable that their children will not disturb others. Parents also have an interest in allowing their children to socialize with other children in a safe environment. There has been a dramatic increase in people's desire to congregate in coffee shops in the United States and abroad. For many, the local coffee shops have become a "hang-out" for doing work and socializing. Other restaurants have had similar draws, but not in quite the same congregating nature. While such coffee shops offer many a social gathering spot, many young adults (i.e., those in their late teens and early 20's), have "graduated" from the coffee shops as they entered parenthood. Once in parenthood, the ability for the new parents to find parent-child "hang-outs" is limited.

There are other types of businesses that focus on children activities, such as gyms that cater to children, swim classes for children, pre-school, and so on. However, in each of these cases, the focus is on the children, and the parents are unable to satisfy their own socializing desires.

SUMMARY

An example embodiment of the present invention provides for a café that provides a primary play area that has wall(s) that are substantially transparent and located in a central location within the café with seats positioned around the primary play area, thereby enabling parents to eat and socialize while maintaining a clear view of their children. The wall(s) may be formed of glass or other transparent material that is mounted to and extends from the floor and ceiling to reduce noise from the children playing to avoid overly interfering with the parents who are socializing. In the case where there are multiple walls, a polygon, such as an octagon, may be used to maximize the area in which the children have to play and increase viewing areas in which parents may be positioned to view their children playing in the primary play area. In one embodiment, seating and tables may be set around the primary play area with the seats facing the primary play area.

The café may also include play station(s) that have seats surrounding a play area defined by wall(s) in which the children may play, where the seats overlook the play area. The play stations may be "soft" play areas in which babies and toddlers may play. The play stations may have age restrictions to avoid having an older, bigger child with a younger, smaller child in the same play station. Each of the play station(s) may have a table or countertop surface that allows for the parents to maintain a constant visual view of their children. In one embodiment, the countertop surface may be attached to wall (s) of the play station(s). Alternatively, the countertop surface may be separate from the wall(s).

While the café may provide food for both parents and children, the café may also offer structured classes for children, children and adults, and adults only. The structured classes may be physical education classes (e.g., baby stretching), adult educational classes (e.g., parenting classes), play classes (e.g., games), and so on. By providing both food and classes, the parents may feed their children prior to or after the classes without having to switch locations and also allow the parents to socialize with other parents.

One embodiment of a café may include a food purchasing area, a primary dining area, and a primary child play area. The primary child play area may be defined by at least one wall positioned within a central region of the primary dining area. The wall(s) may be substantially transparent. Seats may be positioned around the primary child play area to enable parents to view children within the primary child play area.

Another embodiment of a café may include a play station in which children can play. The play station may include at least one wall defining a perimeter of the play station. Seats may be positioned around the play station. The height of the walls may be positioned below that of a head of an adult sitting on one of the seats to enable the adult to view a child within the play station.

One embodiment of a method for constructing a café may include installing at least one substantially transparent wall within a central region of a primary dining area, where the substantially transparent wall(s) define a primary play area in which children can play. Seats may be positioned around the wall(s) to enable parents to view children within the primary child play area.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE DRAWINGS

While there are several restaurant chains that have children play areas, those play areas are typically off to the side or require the parents to be physically in the play area to ensure safety of their children, as viewing their children is difficult from within the restaurant itself. In some cases, there are opaque walls that block the view of the children. In other cases, the seating is behind walls or other seats are positioned in such a manner that the children cannot be seen.

Stay-at-home mothers or fathers who may have a desire to socialize with other adults have limited options in finding an environment in which (i) their children can play and learn, (ii) they can socialize in an environment where food, which includes both food and drinks (e.g., coffee), is available for both them and their children, and (iii) they have the ability to easily watch their children playing in play areas.

Figure 1:
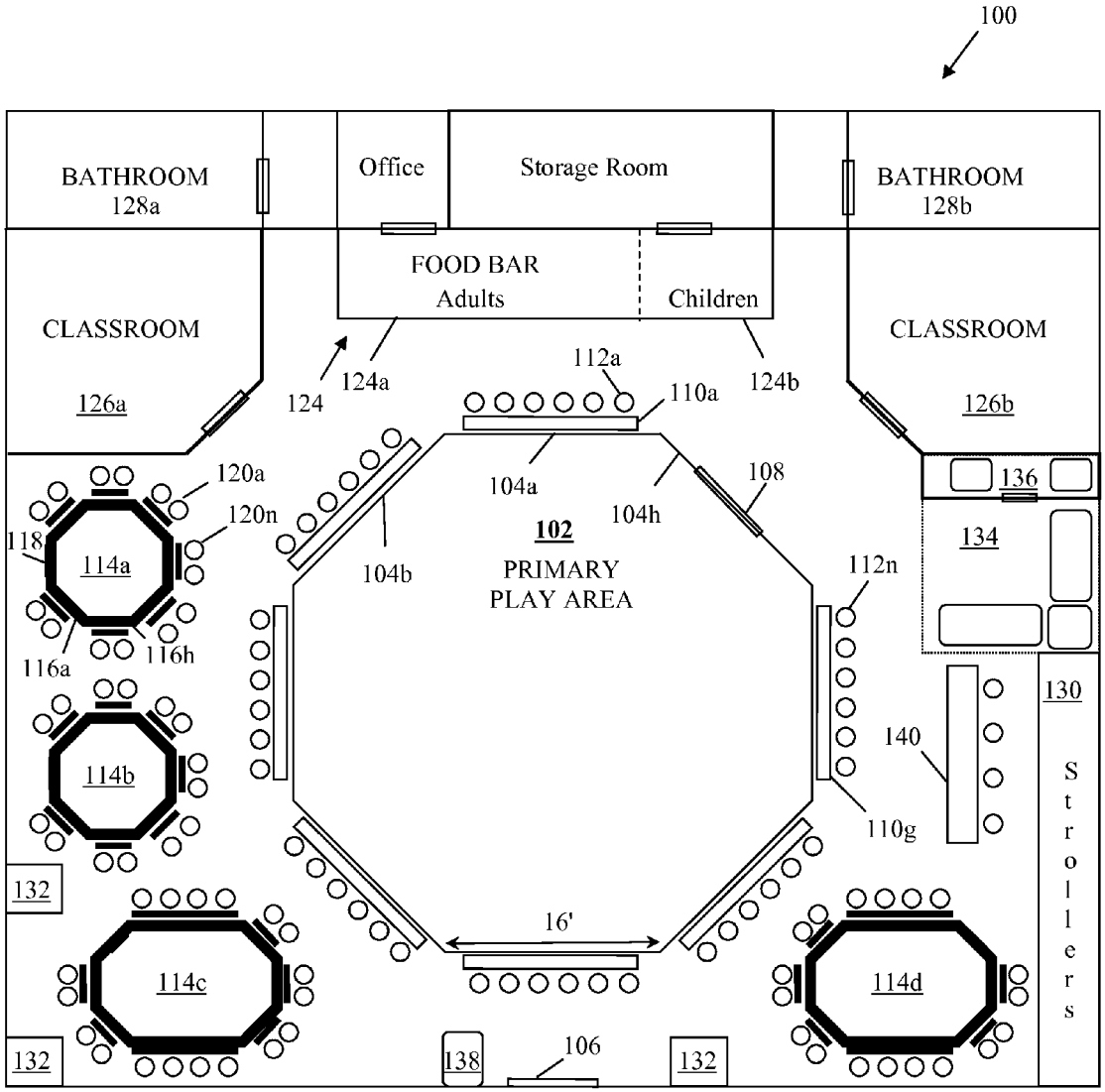
FIG. 1 is a top view of an illustrative café according to an embodiment of the present invention that provides for a primary play area and multiple play stations in which children may play.

With regard to FIG. 1, an illustration of a top view of an illustrative café 100 is shown. The café 100 includes a primary play area 102 in which children may play. The primary play area 102 may include a variety of different activities, including a toy area (e.g., trains, trucks, dolls, doll houses, etc.), climbing apparatus (e.g., slide, tubes, ladders, jungle gym, etc.), clothing area (e.g., dresses, costumes, hats, etc.).

In one embodiment, the primary play area 102 is defined by eight walls 104*a*-104*h* (collectively 104) that form an octagon. Other polygon configurations (i.e., different number of walls) may be utilized to define the primary play area 102. Still yet, the number of walls may be one, which may be an oval, circle, or any other geometric shape. Each of the walls may be substantially transparent (hereinafter "transparent"), where significant portions of the walls 104 are transparent.

By the walls 104 being transparent, parents around the primary play area 102 may view their children playing therein. The walls 104 may be transparent from top to bottom. Alternatively, the walls 104 may be transparent from top to close to the bottom (e.g., bottom foot being opaque). Still yet, opaque frames (e.g., wood) may extend between the walls 104 to secure adjacent walls. The walls 104 may be composed of glass, Plexiglas, or any other transparent material, as understood in the art.

As the café is to provide comfort to adults as well as enable children to play, the walls 104 may extend from the floor to the ceiling to reduce noise from children playing in the primary play area 102 does not enter into the dining area so that the parents may talk with one another. In one embodiment, sound absorbent material (not shown) may be placed on the ceiling above the primary play area 102 to further absorb sound from the children playing. The sound absorbent material may be any porous material. In one embodiment, the sound absorbent material is highly sound absorbent (i.e., more sound absorbent than conventional ceiling tiles). In one embodiment, the sound absorbent material may be positioned above a drop ceiling, as understood in the art.

In addition to the ceiling being highly sound absorbent, material covering the floor of the primary play area 102 may be a sound absorbent material. Similar to the sound absorbent material positioned above the primary play area 102, the sound absorbent material may be highly sound absorbent. The sound absorbent material may be a play mat or material positioned below a play mat. The play mat may be a foam, rubber, or other material that children may play on to avoid injury, as understood in the art. Using the sound absorbent material above and below the primary play area 102, the noise created by children within glass or other sound reflecting walls 104 may be reduced and have limited echoes.

One or more of the walls 104 may include a door 108 through which people may enter and exit the primary play area 102. The door 108 may be spring loaded to cause the door to close behind children and adults to ensure that the door remains closed unless someone is entering or exiting. Alternatively, the door may be automated so that it can be automatically opened and closed by pressing a button, pulling a handle or rope, or through use of a motion sensor. To protect children playing in the primary play area 102, a structure may be positioned to shield children playing in the play area from being hit by the door 108 if opened into the play area. The door may have a seal around the doorframe that is sound absorbent to minimize the amount of sound that exits from the primary play area 102. The door 108 may be transparent to match the walls 104 and to reduce potential injury to people entering and exiting from the primary play area 102. In one embodiment, opaque strips of material (e.g., colored tape) may be attached to the door 108 or etchings may be applied to the door 108 to allow people to more clearly identify the position of the door 108, thereby avoiding injury due to people not seeing the door 102 due to its being transparent. As shown, the door 108 is positioned on wall 104*h* that is away from an entryway 106 of the café to reduce the ability for a child to exit the primary play area 102 and entryway 106 without a parent noticing. Having the door 108 on a wall of the primary play area 102 opposite from the entryway 106 of the café also reduces the chance for a child predator from removing a child from the primary play area and escaping out the entryway 106.

A number of tables 110*a*-110*g* (collectively 110) may be positioned around the primary play area 102. As shown, the tables 110 may be rectangular shaped. Other geometric shapes may be utilized. The tables 110 may extend parallel to each respective wall 104*a*-104*g*. In one embodiment, to maintain organization within the café, the tables 110 may be bolted to the floor. Alternatively, the tables 110 may be free-standing tables. As shown, tables 110 may be positioned around the primary play area 102 along seven of the eight walls 104. Other configurations may be utilized, but having seven tables provides for sufficient space for parents to watch their children within the primary play area 102 and socialize with other parents. Because the café is meant to serve drinks (e.g., coffee) and light foods (e.g., sandwiches and desserts), the tables 110 may be relatively narrow in width.

Seats 112*a*-112*n* (collectively 112) may positioned on the opposite side of the tables from the primary play area 102 to enable parents whose children are playing within the primary play area to maintain a constant watch over their children. By not positioning seats between the tables 110 and the primary play area 102, unobstructed views of the children within the primary play area 102 may be maintained. In an alternative embodiment, rather than positioning tables between the seats and the transparent walls of the primary play area, tables may be positioned between the seats. As with the tables 110, the seats 112 may be mounted to the floor or be movable. The seats 112 are shown to be circular. However, the seats may be any configuration, as understood in the art.

One or more play stations 114*a*-114*d* (collectively 114) may be arranged throughout the café. The play stations 114 may be play areas for infants and toddlers who are too young or small to play in the primary play area 102 with larger children. The play stations 114 may include one or more walls. In one embodiment, the play stations 114 may have eight walls 116*a*-116*h* (collectively 116). Other numbers of walls may be utilized. The play stations 114 may be "soft areas" that have soft padding on the floor and inside walls of the play stations 114. As shown, seats 120*a*-120*n* (120) may be positioned around the walls 116 of play station 114*a*. One of the walls 116*b* may have a door 118 that enables people to enter and exit the play station 114*a*. For the same reasons as the placement of the door 108 of the primary play area, the door 118 may be positioned on the opposite side of the play station 114*a* from the entryway 106 of the café. Tables 122*a*-122*g* (collectively 122) may be positioned between respective walls 116*a*-116*g* and seats to enable parents to place drinks (e.g., coffee), food (e.g., sandwiches), and other items (e.g., paperwork).

A food bar 124 may have an adult side 124*a* and children's side 124*b*, where the two sides 124*a* and 124*b* serve food that are age appropriate. For example, the adult side 124*a* may serve coffees, sodas, protein shakes, and, optionally, wine, for example. The adult side 124*a* may also serve sandwiches, salads, and other typical café foods. The children side 124*b* may serve milk, juices, and formula (for infants). The children side 124*b* may also serve baby foods, including fruits and vegetables prepared for babies, child-sized sandwiches, and any other foods that are meant for 0-6 year olds. To avoid having liability for children with nut allergies, certain foods may be nut-free.

In one embodiment, adults and children may be given in-store loyalty cards that can be used to make purchases at respective sides 124*a* and 124*b*. The in-store loyalty cards may be prepaid cards that have a certain amount of credit or points that can be used to purchase food and other items, as described below. The in-store loyalty cards may also enable children to make purchases on the children's side 124*b*. Furthermore, the loyalty cards may be used to accumulate points that can be used for prizes or privileges.

In addition to serving food, the food bar 124 may sell a variety of baby products. For example, the food bar may sell diapers, wipes, bottles, sippy cups, plastic bowls, utensils, bibs, clothing, toys, stuffed animals, videos, music, event tickets (e.g., circus), and any other product that is age appropriate.

Classrooms 126*a* and 126*b* (collectively 126) may be used for educational purposes and party purposes. Classes may be established for parents and children, parents alone, and/or children alone. The classes may include new parenting classes, child and parent exercise classes, child development classes, pre-school classes, parent relationship classes, and any other classes. The classrooms may be multipurpose in that shows (e.g., magician, puppet shows, juggling, music, movies, and any other shows) may be offered while not in use for scheduled classes. By providing classrooms within the café, parents may bring their children to a location that not only provides food and fun, but also provides education.

Bathrooms 128*a* and 128*b* (collectively 128) may be set up for men and women. Because the café is family oriented, the bathrooms 128 may be configured to accommodate the needs of new mothers with infants. For example, rather than having a single changing station, multiple changing stations may be provided in each of the bathrooms. Also, because many children may not be fully potty trained, toilet stalls may be set up to allow for child toilets and adult toilets, thereby allowing adults feel more comfortable when using the facilities.

Because the café is child friendly, it is anticipated that a large number of strollers or baby carriers will be brought to the café. A stroller parking area 130 may accommodate strollers and baby carriers that are brought by parents. The stroller parking area 130 may accommodate strollers that do not fold by having enough floor space for a certain number of strollers (e.g., 10), hooks that can hold fold-up strollers, and bins that can hold baby carriers.

Highchair bins 132 may be located in convenient locations throughout the café. As shown, the highchair bins 132 may be locations that are nothing but floor space with signs or other markings to indicate that highchairs are to be stacked in that location or be physical structures that assist with maintaining the highchairs in an orderly manner. The highchairs may be available for parents to use and return to the highchair bins 132.

A parent comfort area 134 may be set-up to allow parents to be more comfortable than sitting on the seats 112 and 120. The parent comfort area 134 may include couches and chairs that are more comfortable and easier for parents to feed babies from bottles. A breast-feeding area 136 may be located at the parent comfort area 134. The breast-feeding area 136 may be draped or have a physical structure to provide privacy for nursing mothers. One or more comfortable seats may be located in the breast-feeding area 136. It should be understood that the breast-feeding area 136 may be positioned elsewhere throughout the café, such as an area in or near the bathroom.

A guest welcoming station 138 may be positioned at the entryway door 106 to allow personnel to welcome guests and assist with in-store loyalty cards. The guest welcoming station 138 may be located anywhere throughout the café, including being merged in with the food bar 124.

A computer worktable 140 may be available for parents to use for working on computers and papers. In a similar manner as the seats 112 being behind tables 110 with respect to the primary play area 102, seats 142 may be behind computer worktable 140 with respect to the primary play area 102, thereby enabling parents to keep a watch over their children in the primary play area 102.

Figure 2:
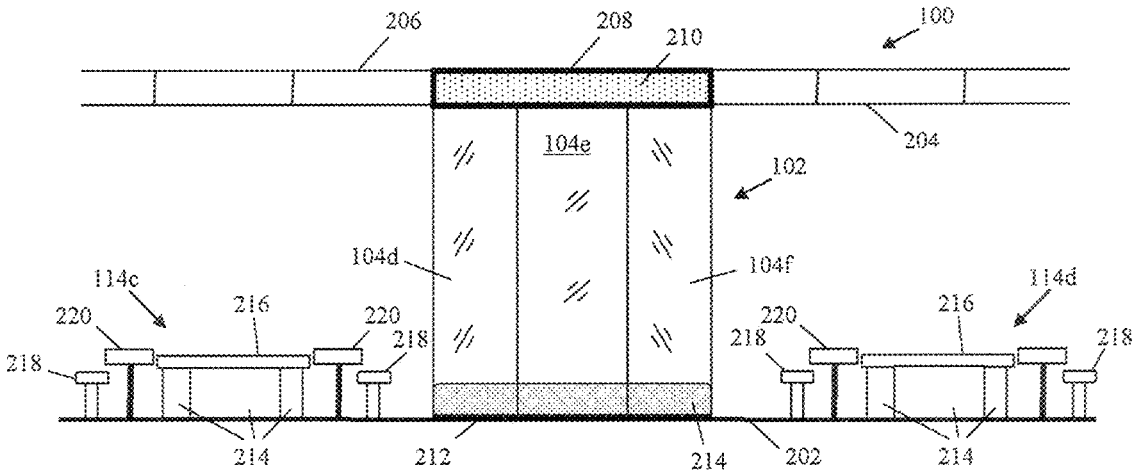
FIG. 2 is an illustration of a side view of the café of FIG. 1.

All dimensions shown in FIG. 1 are illustrative and the shape and sizes may be varied based on actual retail space dimensions and configurations With regard to FIG. 2, a side view of the café 100 is shown. The primary play area 102 is shown with walls 104*d*-104*f* extending from floor 202 to ceiling 204. As shown, the ceiling 204 is a drop ceiling from roof 206. Sound absorbent material 208 that is highly sound absorbent may be positioned above the primary play area 102. The drop ceiling 204 be below the sound absorbent material 208 so that it does not look different from the rest of the ceiling 204 in the café. In one embodiment, insulation or other sound dampening material 210 may be placed above the primary play area 102. While the walls 104 of the primary play area 102 are shown to extend from the floor 202 to the ceiling 204, it should be understood that the walls 104 may not extend to the ceiling. Fasteners (not shown) may secure the walls 104 to the floor and to the ceiling. The fasteners may include brackets, mounts, bolts, screws, adhesive, or any other fastening member. Flooring 212 that protects children from falling and being injured may be positioned on the floor 202. The flooring 212 may be foam, rubber, or any other material, as understood in the art.

To improve safety within the primary play area 102, bumpers 212 may be positioned to the base of the walls 104. The bumpers 212 may be durable plastic, air-filled bags that are secured to the walls 104 and floor 202 to prevent children from pulling them off or away from the walls 104. The bumpers 212 may alternatively be foam or rubber without being air-filled. If the bumpers 212 are transparent or semi-transparent, parents may be able to see their children without being blocked by the bumpers 212. The bumpers 212 may be 12-24 inches tall and be ½"-2" thick depending on the material.

The play stations 114*c* and 114*d* are shown to include the walls 214 with an upper rim support member 216 to make the walls 214 more sturdy. The walls 214 do not need to be transparent as the parents may more easily see in the play stations 114*c* and 114*d*. Seats 218 may be stools that may or may not be mounted to the floor 202. In one embodiment, tables 220 may be positioned to the side of the seats 218 to enable the seats to be closer to the walls 214 to allow parents to be closer to their children within the play stations 114*c* and 114*d*. Alternatively, the seats 218 may be positioned behind the tables 220 with respect to the play stations 114*c* and 114*d*.

Figure 3:
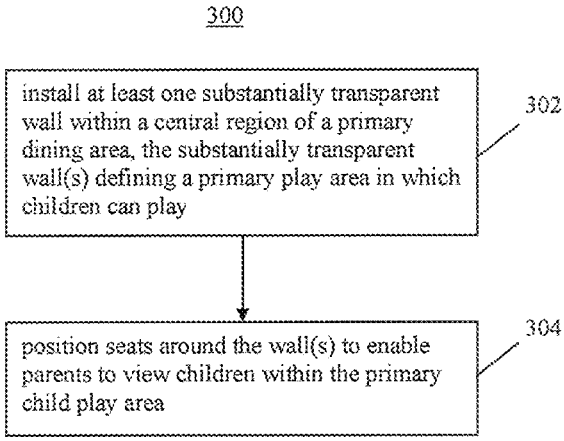
FIG. 3 is a flow diagram of an illustrative process for configuring the café of FIG. 1.

With regard to FIG. 3, a flow diagram of an illustrative process 300 for constructing a café may include installing at least one substantially transparent wall within a central region of a primary dining area at step 302. The substantially transparent wall(s) define a primary play area in which children can play. Toys, structures, and other items that children enjoy playing with may be positioned within the primary play area. In addition, the primary play area may be subdivided into areas in which children of different age ranges may play. At step 304, seats may be positioned around the wall(s) to enable parents to view children within the primary child play area.

The previous description is of a preferred embodiment for implementing the invention, and the scope of the invention should not necessarily be limited by this description. The scope of the present invention is instead defined by the following claims.

We claim:

1. A café, comprising:

a food purchasing area;

a primary dining area;

a primary child play area defined by at least one wall, said primary child play area being surrounded by said primary dining area, said at least one wall being substantially transparent and extending from floor to ceiling; and a plurality of seats positioned around said primary child play area to enable parents to view children within said primary child play area.

2. The café according to claim 1, wherein the at least one wall is defined by eight walls.

3. The café according to claim 1, further comprising first tables positioned between the seats and primary dining area to enable the parents to view their children within said primary child play area.

4. The café according to claim 1, further comprising at least one play station including at least one respective secondary child play area defined by at least one second wall and a plurality of second seats positioned around the at least one second wall.

5. The café according to claim 4, further comprising a tabletop surface positioned between said second seats and said at least one play station.

6. The café according to claim 4, wherein said at least one play station includes a door connected to the at least one second wall that enables children to enter into the at least one respective secondary child play area, the door being positioned on an opposite side of the at least one respective secondary child play area and an entryway into the café.

7. The café according to claim 1, further comprising at least one classroom in which classes for the children are conducted.

8. The café according to claim 1, further comprising padding positioned at a bottom portion of the at least one wall, said padding being substantially transparent to enable parents to view their children in said primary child play area.

9. The café according to claim 1, further comprising:

at least one second tables positioned farther from said primary play area than said seats; and a plurality of second seats positioned behind said at least one second tables with respect to said primary play area to enable parents to view their children in said primary play area.

10. The café according to claim 1, wherein said food purchasing area is further configured to provide for adult and children purchases of food.

11. The café according to claim 1, further comprising one and only one doorway connected to the at least one wall of said primary child play area, the doorway being positioned on an opposite side of the primary child play area with respect to an entryway into the café.

12. The café according to claim 1, further comprising sound absorbent material positioned above said primary play area, said sound absorbent material being highly sound absorbent.

13. The café according to claim 12, wherein the sound absorbent material is positioned above a drop ceiling.

14. A method for constructing a café, said method comprising:

installing at least one substantially transparent wall that extends from floor to ceiling so as to define a primary child play area in which children can play and being surrounded by a primary dining area; and positioning a plurality of seats around the at least one wall to enable parents to view children within the primary child play area.

15. The method according to claim 14, further comprising installing one and only one doorway to the at least one wall of said primary play area, the doorway being positioned on an opposite side of the primary play area with respect to an entryway into the café.

16. The method according to claim 14, further comprising installing at least one play station including at least one respective secondary child play area defined by at least one second wall and a plurality of second seats positioned around the at least one second wall.

17. The method according to claim 14, further comprising installing at least one classroom in which classes for the children are conducted.

18. The method according to claim 14, further comprising installing sound absorbent material positioned above the primary play area, the sound absorbent material being highly sound absorbent.

19. A café, comprising:

a food purchasing area;

a primary dining area;

a primary child play area defined by at least one wall, said primary child play area being surrounded by said primary dining area, said at least one wall being substantially transparent;

a plurality of seats positioned around said primary child play area to enable parents to view children within said primary child play area; and at least one play station including at least one respective secondary child play area defined by at least one second wall and a plurality of second seats positioned around the at least one second wall.

20. The café according to claim 19, wherein the at least one wall extends from floor to ceiling.

21. The café according to claim 19, further comprising a tabletop surface positioned between said second seats and said at least one play station.

22. The café according to claim 19, further comprising at least one classroom in which classes for the children are conducted.

23. The café according to claim 19, further comprising padding positioned at a bottom portion of the at least one wall, said padding being substantially transparent to enable parents to view their children in said primary child play area.

24. The café according to claim 19, further comprising sound absorbent material positioned above said primary play area, said sound absorbent material being highly sound absorbent.

25. A café, comprising:

a food purchasing area;

a primary dining area;

a primary child play area defined by at least one wall, said primary child play area being surrounded by said primary dining area, said at least one wall being substantially transparent;

a plurality of seats positioned around said primary child play area to enable parents to view children within said primary child play area; and at least one classroom in which classes for the children are conducted.

26. The café according to claim 25, wherein the at least one wall extends from floor to ceiling.

27. The café according to claim 25, further comprising at least one play station including at least one respective secondary child play area defined by at least one second wall and a plurality of second seats positioned around the at least one second wall.

28. The café according to claim 25, further comprising at least one classroom in which classes for the children are conducted.

29. The café according to claim 25, further comprising padding positioned at a bottom portion of the at least one wall, said padding being substantially transparent to enable parents to view their children in said primary child play area.

30. The café according to claim 25, further comprising sound absorbent material positioned above said primary play area, said sound absorbent material being highly sound absorbent.

31. A café, comprising:

a food purchasing area;

a primary dining area;

a primary child play area defined by at least one wall, said primary child play area being surrounded by said primary dining area, said at least one wall being substantially transparent;

sound absorbent material positioned above said primary play area, said sound absorbent material being highly sound absorbent; and a plurality of seats positioned around said primary child play area to enable parents to view children within said primary child play area.

32. The café according to claim 31, wherein the at least one wall extends from floor to ceiling.

33. The café according to claim 31, further comprising at least one play station including at least one respective secondary child play area defined by at least one second wall and a plurality of second seats positioned around the at least one second wall.

34. The café according to claim 31, further comprising at least one classroom in which classes for the children are conducted.

35. The café according to claim 31, further comprising padding positioned at a bottom portion of the at least one wall, said padding being substantially transparent to enable parents to view their children in said primary child play area.

36. The café according to claim 31, further comprising at least one classroom in which classes for the children are conducted.

* * * * *